US006125940A

United States Patent [19]

Oram

[11] Patent Number: 6,125,940

[45] Date of Patent: Oct. 3, 2000

[54] FIRE EXTINGUISHER PRESSURE ALARM

[76] Inventor: Stanley C. Oram, 899 Rossland Road West Unit 40, Oshawa, Ontario, Canada, L1J 8G7

[21] Appl. No.: 09/195,828

[22] Filed: Nov. 19, 1998

[51] Int. Cl.[7] ..... A62C 13/76

[52] U.S. Cl. ..... 169/23; 169/75

[58] Field of Search ..... 169/75, 30, 23; 73/700, 709; D10/85

[56] References Cited

U.S. PATENT DOCUMENTS

| | | | |
|---|---|---|---|
| 2,605,848 | 8/1952 | Carter | 169/75 |
| 4,289,207 | 9/1981 | Wernert | 169/30 |
| 5,775,430 | 7/1998 | McSheffrey | 169/30 |
| 5,808,541 | 9/1998 | Goldden | 169/60 X |

FOREIGN PATENT DOCUMENTS

| | | | |
|---|---|---|---|
| 3609499 | 9/1987 | Germany | 169/75 |

*Primary Examiner*—Lesley D. Morris

[57] ABSTRACT

A pressure indicating system is provided including a housing having an extension mounted thereon adapted for being releasably engaged with a fire extinguisher. Also includes is a battery compartment mounted within the housing for containing at least one battery. Next provided is a pressure gauge adapted for providing an indication of an amount of pressure at which the contents of the fire extinguisher reside. A visual indicator is mounted on the housing. Further, a control driver is adapted to provide an indication of an amount of pressure of the contents within the fire extinguisher by way of the visual indicator.

10 Claims, 2 Drawing Sheets

FIRE EXTINGUISHER PRESSURE ALARM

BACKGROUND OF THE INVENTION

1. Field of the Invention

The present invention relates to fire extinguisher refill indicators and more particularly pertains to a new fire extinguisher pressure alarm for indicating when a dry chemical fire extinguisher is either under or over-charged.

2. Description of the Prior Art

The use of fire extinguisher refill indicators is known in the prior art. More specifically, fire extinguisher refill indicators heretofore devised and utilized are known to consist basically of familiar, expected and obvious structural configurations, notwithstanding the myriad of designs encompassed by the crowded prior art which have been developed for the Fulfillment of countless objectives and requirements.

Known prior art fire extinguisher refill indicators and the like include U.S. Pat. No. 3,735,376; U.S. Pat. No. 4,532,996; U.S. Pat. No. 2,393,346; U.S. Pat. No. 3,664,430; U.S. Pat. No. 3,576,412; and U.S. Pat. No. 3,333,641.

In these respects, the fire extinguisher pressure alarm according to the present invention substantially departs from the conventional concepts and designs of the prior art, and in so doing provides an apparatus primarily developed for the purpose of indicating when a dry chemical fire extinguisher is either under or over-charged.

SUMMARY OF THE INVENTION

In view of the foregoing disadvantages inherent in the known types of fire extinguisher refill indicators now present in the prior art, the present invention provides a new fire extinguisher pressure alarm construction wherein the same can be utilized for indicating when a dry chemical fire extinguisher is either under or over-charged.

The general purpose of the present invention, which will be described subsequently in greater detail, is to provide a new fire extinguisher pressure alarm apparatus and method which has many of the advantages of the fire extinguisher refill indicators mentioned heretofore and many novel features that result in a new fire extinguisher pressure alarm which is not anticipated, rendered obvious, suggested, or even implied by any of the prior art fire extinguisher refill indicators, either alone or in any combination thereof.

To attain this, the present invention is adapted for use with a dry chemical fire extinguisher having a threaded aperture in communication with contents of the fire extinguisher. The present invention includes a housing having a disk-shaped configuration with a front face, a rear face, and a periphery formed therebetween. The rear face has a threaded extension centrally mounted thereon and extended therefrom in coaxial relationship. The threaded extension is adapted for being releasably engaged within the threaded aperture of the fire extinguisher during use. Next provided is a battery compartment mounted within the housing and accessible via a rectangular cut out formed in the rear face of the housing below the threaded extension. As shown in FIG. 3, the battery compartment further has a lid snappily coupled to the housing for selectively covering the battery compartment. In operation, at least one battery is removably positioned within the battery compartment. The housing further has a speaker mounted therein adjacent to a grill formed in a central extent of the front face thereof. The speaker is adapted for providing an audible alarm during the actuation thereof. FIG. 4 shows a variable resistance pressure gauge that is mounted within the threaded extension of the housing. During use, the pressure gauge is adapted for providing an indication of an amount of pressure at which the contents of the fire extinguisher reside. FIG. 1 shows a semicircular translucent screen mounted on the front face of the housing. Such translucent screen is divided into a first side section, a central section, and a second side section each having a unique color when light is passed therethrough. Associated therewith is a light assembly including a plurality of lights positioned within the housing adjacent to the screen in side-by-side relationship. Each light is adapted for passing light through the corresponding section upon the actuation thereof. A control driver is connected between the battery, pressure gauge, and light assembly. In use, the control driver serves to actuate the lights of the light assembly from a first end of the screen to a second end of the screen as the pressure increases within the fire extinguisher. In addition, the control driver is adapted to actuate the speaker intermittently upon the lights of the light assembly adjacent to the ends of the screen are actuated. As such, an audible indication is provided for when the fire extinguisher is overcharged and further when the fire extinguisher is undercharged.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at leas one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire extinguisher pressure alarm apparatus and method which has many of the advantages of the fire extinguisher refill indicators mentioned heretofore and many novel features that result in a new fire extinguisher pressure alarm which is not anticipated, rendered obvious, suggested, or even implied by any of the prior art fire extinguisher refill indicators, either alone or in any combination thereof.

It is another object of the present invention to provide a new fire extinguisher pressure alarm which may be easily and efficiently manufactured and marketed.

It is a further object of the present invention to provide a new fire extinguisher pressure alarm which is of a durable and reliable construction.

An even further object of the present invention is to provide a new fire extinguisher pressure alarm which is susceptible of a low cost of manufacture with regard to both materials and labor, and which accordingly is then susceptible of low prices of sale to the consuming public, thereby making such fire extinguisher pressure alarm economically available to the buying public.

Still yet another object of the present invention is to provide a new fire extinguisher pressure alarm which provides in the apparatuses and methods of the prior art some of the advantages thereof, while simultaneously overcoming some of the disadvantages normally associated therewith.

Still another object of the present invention is to provide a new fire extinguisher pressure alarm for indicating when a dry chemical fire extinguisher is either under or overcharged.

Even still another object of the present invention is to provide a new fire extinguisher pressure alarm that includes a housing having an extension mounted thereon adapted for being releasably engaged with a fire extinguisher. Also included is a battery compartment mounted within the housing for containing at least one battery. Next provided is a pressure gauge adapted for providing an indication of an amount of pressure at which the contents of the fire extinguisher reside. A visual indicator is mounted on the housing. Further, a control driver is adapted to provide an indication of an amount of pressure of the contents within the fire extinguisher by way of the visual indicator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
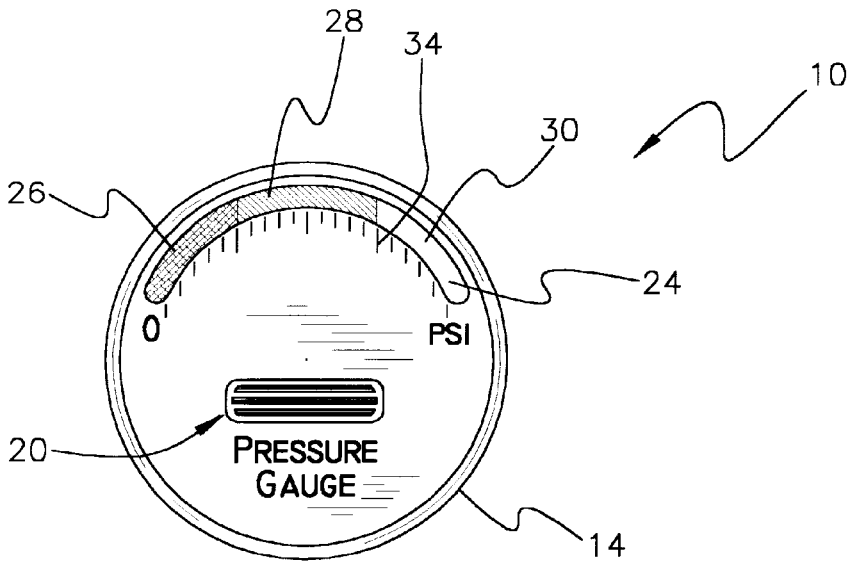
FIG. 1 is a front view of a new fire extinguisher pressure alarm according to the present invention.
Figure 2:
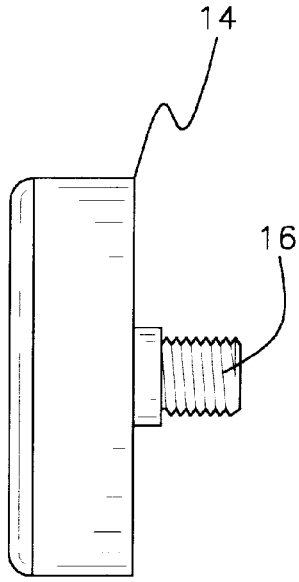
FIG. 2 is a side view of the present invention.

With reference now to the drawings, and in particular to FIGS. 1 through 4 thereof, a new fire extinguisher pressure alarm embodying the principles and concepts of the present invention and generally designated by the reference numeral 10 will be described.

The present invention, designated as numeral 10, is adapted for use with a dry chemical fire extinguisher having a threaded aperture in communication with contents of the fire extinguisher.

The present invention includes a housing 14 having a disk-shaped configuration with a front face, a rear lace, and a periphery formed therebetween. The rear face has a threaded extension 16 centrally mounted thereon and extended therefrom in coaxial relationship. The threaded extension is adapted for being releasably engaged within the threaded aperture of the fire extinguisher during use.

Figure 3:
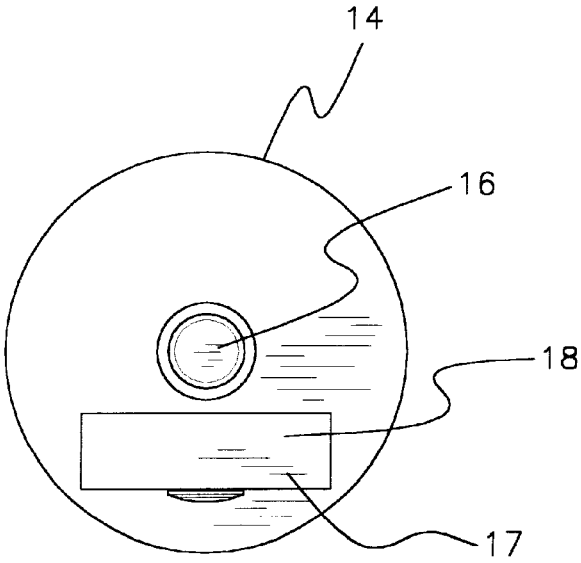
FIG. 3 is a rear view of the present invention.

Next provided is a battery compartment 17 mounted within the housing and accessible via a rectangular cut out formed in the rear face of the housing below the threaded extension. As shown in FIG. 3, the battery compartment further has a lid 18 snappily coupled to the housing for selectively covering the same. In operation, at least one battery is removably positioned within the battery compartment.

Figure 4:
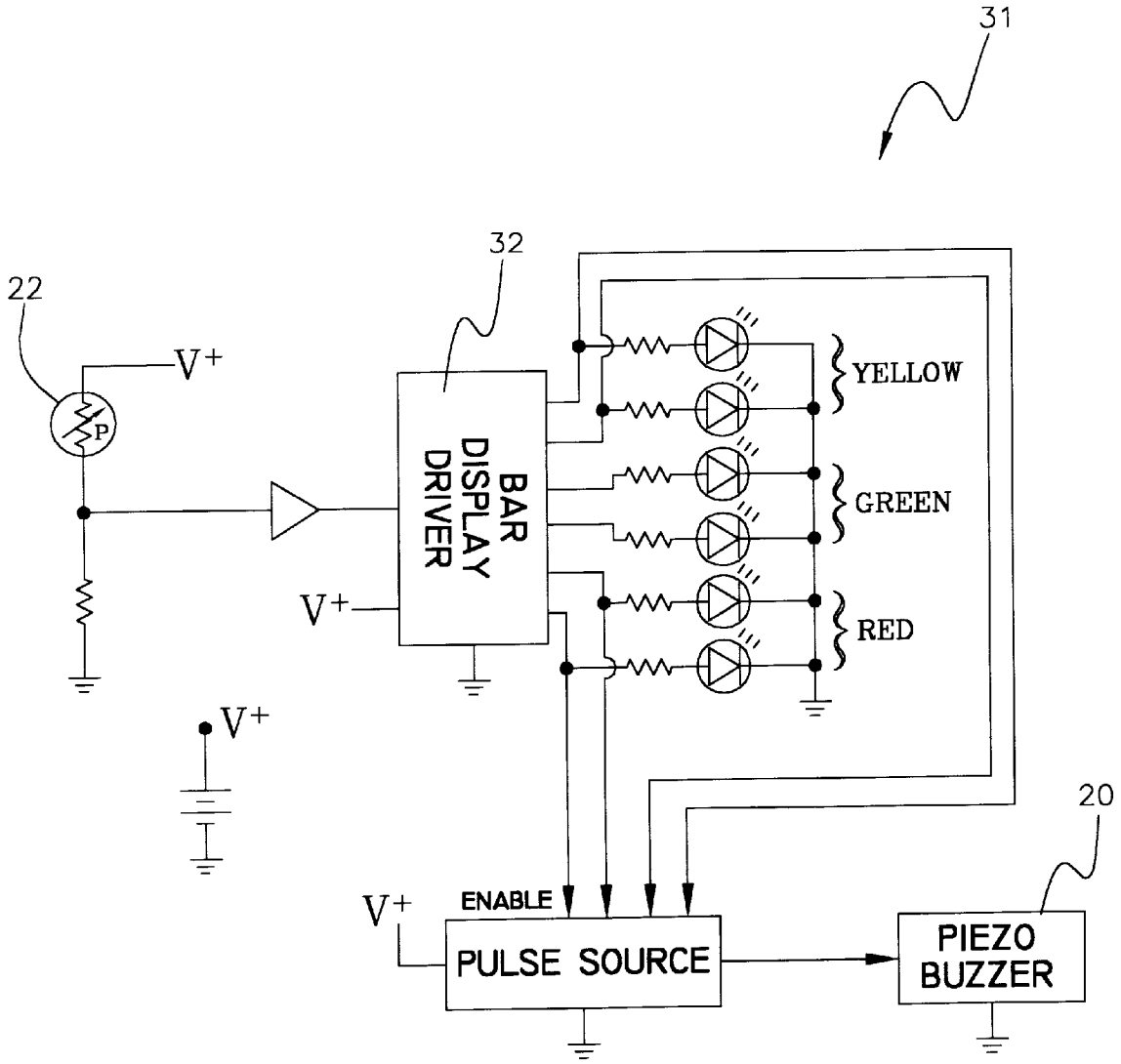
FIG. 4 is a schematic diagram of the various components of the present invention.

The housing further has a speaker 20, or buzzer, mounted therein adjacent to a grill formed in a central extent of the front face thereof. The speaker is adapted for providing an audible alarm during the actuation thereof. FIG. 4 shows a variable resistance pressure gauge 22 that is mounted within the threaded extension of the housing. During use, the pressure gauge is adapted for providing an indication of an amount of pressure at which the contents of the fire extinguisher reside. An unillustrated bore may be formed in the rear face of the threaded extension to allow communication between the pressure gauge and the fire extinguisher contents.

FIG. 1 shows a semicircular or inverted U-shaped translucent screen 24 mounted on the front face of the housing. Such translucent screen is divided into a first side section 26, a central section 28, and a second side section 30 each having a unique color when light is passed therethrough. Ideally, such colors are red, green and yellow, respectively. Associated therewith is a light assembly 31 including a plurality of LED lights positioned within the housing adjacent to the screen in side-by-side relationship. Each light is adapted for passing light through the corresponding section upon the actuation thereon.

A bar display control driver 32 is connected between the battery, pressure gauge, and light assembly. Ideally, an additional resister is connected to the pressure gauge in order to render a voltage divider. Further, an operational amplifier is preferably connected between the voltage divider and the control driver. In use, the control driver serves to actuate the lights of the light assembly from a first end of the screen to a second end of the screen as the pressure increases within the fire extinguisher. Ideally, the lights of the first side section are illuminated which is followed by those of the central section that is in turn followed by the light of the second side section.

In addition, the control driver is adapted to actuate the speaker intermittently upon the lights of the light assembly adjacent to the ends of the screen are actuated or in other words, when lights of either the first or second side section are illuminated. As such, an audible indication is provided for when the fire extinguisher is overcharged and further when the fire extinguisher is undercharged. Ideally, a pulse generator is positioned between the control driver and the audible alarm in order to intermittently actuate the speaker.

Finally, pressure measurement indicia 34 is positioned along an underside of the screen for providing an indication of an exact quantity of pressure of the contents of the fire extinguisher. In order for the indicia to accurately indicate the pressure, the control driver must be calibrated to actuate the lights only between certain ranges. It should be readily apparent that with the addition of more lights, such pressure ranges are decreased and the accuracy of the present invention is bettered.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pressure indicating system comprising:

a dry chemical fire extinguisher having a threaded aperture in communication with contents of the fire extinguisher;

a housing having a disk-shaped configuration with a front face, a rear face, and a periphery formed therebetween, the rear face having a threaded extension centrally mounted thereon and extending therefrom in coaxial relationship for being releasably engaged within the threaded aperture of the fire extinguisher;

a battery compartment mounted within the housing and accessible via a rectangular cut out formed in the rear face of the housing below the threaded extension, the battery compartment further having a lid snappily coupled to the housing to selectively cover the battery compartment, wherein at least one battery is removably positioned within the battery compartment;

a speaker mounted within the housing adjacent to a grill formed in a central extent of the front face thereof for providing an audible alarm during the actuation thereof;

a variable resistance pressure gauge mounted within the threaded extension of the housing for providing an indication of an amount of pressure at which the contents of the fire extinguisher reside;

a semicircular translucent screen mounted on the front face of the housing being divided into a first side section, a central section, and a second side section each having a unique color when light is passed therethrough;

a light assembly including a plurality of lights positioned within the housing adjacent to the screen in side-by-side relationship each for passing therethrough upon the actuation thereof;

a control driver connected between the battery, pressure gauge, and light assembly, the control driver adapted to actuate the lights of the light assembly from a first end of the screen to a second end of the screen as the pressure increases within the fire extinguisher, wherein the control driver is adapted to actuate the speaker intermittently upon the lights of the light assembly adjacent to the ends of the screen are actuated, thereby providing an audible indication when the fire extinguisher is overcharged and further providing an audible indication when the fire extinguisher is undercharged; and pressure measurement indicia positioned along an underside of the screen for providing an indication of an exact quantity of pressure of the contents of the fire extinguisher.

2. A pressure indicating system comprising:

a housing having an extension mounted thereon adapted for being releasably engaged with a fire extinguisher;

a battery compartment mounted within the housing for containing at least one battery;

a pressure gauge adapted for providing an indication of an amount of pressure at which the contents of the fire extinguisher reside;

a visual indicator mounted on the housing;

a control driver connected between the battery, pressure gauge, and visual indicator, the control driver adapted to provide an indication of an amount of pressure of the contents within the fire extinguisher by way of the visual indicator; and wherein the visual indicator includes a screen which has three sections which are illuminated with different colors upon certain levels of pressure of the contents being detected.

3. A pressure indicating system as set forth in claim 2 wherein the extension is threaded.

4. A pressure indicating system as set forth in claim 2 wherein a speaker is mounted on the housing and the control driver is adapted to emit an audible signal therefrom upon a pressure being detected which indicates that the fire extinguisher is either overcharged or undercharged.

5. A pressure indicating system as set forth in claim 2 wherein pressure measurement indicia is positioned along the visual indicator for providing an indication of an exact quantity of pressure of the contents of the fire extinguisher.

6. A pressure indicating system comprising:

a housing adapted for being releasably mounted on a fire extinguisher;

a pressure gauge adapted for providing an indication of an amount of pressure of contents of the fire extinguisher reside;

a visual indicator mounted on the housing;

a control driver operatively connected to the pressure gauge and the visual indicator, the control driver being adapted to provide an indication of the amount of pressure of the contents in the fire extinguisher by way of the visual indicator; and wherein the visual indicator includes a screen which has three sections which are illuminated with different colors upon detection certain amounts of pressure of the contents in the fire extinguisher.

7. A pressure indicating system as set forth in claim 6 wherein a speaker is mounted on the housing and the control driver is adapted to emit an audible signal therefrom upon a pressure being detected which indicates that the fire extinguisher is either overcharged or undercharged.

8. A pressure indicating system as set forth in claim 6 wherein pressure measurement indicia is positioned along the visual indicator for providing an indication of an exact amount of pressure of the contents of the fire extinguisher.

9. The pressure indication system as set forth in claim 6 additionally comprising a battery compartment located in the housing, the battery compartment further having a lid coupled to the housing to selectively cover the battery compartment.

10. The pressure indication system as set forth in claim 6 additionally comprising at least one battery is removably positioned in the housing.

* * * * *